US006648620B2

(12) United States Patent
Yamauchi et al.

(10) Patent No.: US 6,648,620 B2
(45) Date of Patent: Nov. 18, 2003

(54) ROTARY PUMP APPARATUS

(75) Inventors: Kentaro Yamauchi, Kariya (JP); Yoshinori Suzuki, Kariya (JP); Hidetoshi Fujiwara, Kariya (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/993,605

(22) Filed: Nov. 27, 2001

(65) Prior Publication Data

US 2002/0090312 A1 Jul. 11, 2002

(30) Foreign Application Priority Data

Nov. 27, 2000 (JP) ..... 2000-358726

(51) Int. Cl.[7] ..... F04C 2/00
(52) U.S. Cl. ..... 418/259
(58) Field of Search ..... 418/259

(56) References Cited

U.S. PATENT DOCUMENTS 4,486,150 A 12/1984 Davis
4,752,195 A 6/1988 Friedrich et al.
5,046,935 A 9/1991 Iio et al.
5,201,878 A 4/1993 Abe et al.
6,068,461 A 5/2000 Haga et al.

FOREIGN PATENT DOCUMENTS

DE 197 10 418 11/1997
EP 0 481 347 4/1992

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

A rotary pump apparatus includes a stator housing, a pump function component, at least two discharge ports, a ring shaped pressure chamber, an outflow passage and an interception wall. The pump function component is contained in the stator housing. The discharge ports discharge the operation fluid from the pump function component, and are opened into the ring shaped pressure chamber. The pressure chamber is formed in the stator housing and defined with an outer wall and an inner wall. The outflow passage is opened in the pressure chamber. The interception wall is formed in the pressure chamber by connecting one portion of the outer wall and one portion of the inner wall.

6 Claims, 4 Drawing Sheets

ROTARY PUMP APPARATUS

INCORPORATION BY REFERENCE

The present application claims priority under 35 U.S.C. §119 to Japanese Patent Application No. 2000-358726, filed on Nov. 27, 2000. The contents of that application are incorporated herein by reference in its entirety.

BACKGROUND OF THE INVENTION

1. Field of the Invention

This invention relates to a rotary pump apparatus that has a plural number of discharge ports.

2. Discussion of the Background

A conventional vane-type rotary pump apparatus is composed of a stator housing, a cam ring formed at its inner periphery with a cam surface radially offset from its central axis and mounted within the stator housing, a pair of end wall structures fitting to the opposite ends of the cam ring to form a pump cavity in the cam ring, a drive shaft rotatably mounted within the stator housing and extending into the interior of the pump cavity through one of the end wall structures, a rotor contained within the cam ring and mounted on the drive shaft for rotation therewith, and a plurality of cireumferentially equally spaced vanes slidably fitted into a body of the rotor to move radially outward from the rotor and cooperating with the cam surface of the cam ring to form a plurality of expandable pump chambers. FIG. 1 is a cross-sectional view of a conventional pump apparatus. As shown in FIG. 1, the pump apparatus, called a balance-type pump, has an even number (typically two) of discharge ports 91, 92 that open in a ring shape pressure chamber 93. Operating fluid pumped at the pump chambers flows into the pressure chamber 93 through the discharge ports 91, 92 and flows out from the pressure chamber 93 to a flow control valve through an outflow passage 94.

The operating fluid that flows into the pressure chamber 93 from the discharge port 91, which is disposed close to the outflow passage 94, is divided into two streams as it flows to the outflow passage 94. These are a stream flowing clockwise as shown by solid arrows in FIG. 1 and a stream flowing counterclockwise as shown by a dotted arrow in FIG. 1 in the ring shaped pressure chamber 93. The counterclockwise stream collides with the clockwise stream and a stream that flows from the other discharge port 92 near an opening of the outflow passage 94. As a result, these streams create a turbulent flow near the opening of the outflow passage 94. This turbulent flow causes cavitation in the outflow passage 94, which prevents the stable supply of operating fluid to the flow control valve.

SUMMARY OF THE INVENTION

In view of the foregoing, it is an object of the present invention to provide an improved rotary pump apparatus. In order to achieve the above and other objects, the present invention provides a rotary pump apparatus which comprising a stator housing, a pump, at least two discharge ports, a ring shaped pressure chamber, an outflow passage and an interception wall. The pump is contained in the stator housing. The discharge ports discharge the operation fluid from the pump, and are opened in the ring shaped pressure chamber. The pressure chamber is formed in the stator housing and is defined by an outer wall and an inner wall. The outflow passage is opened into the pressure chamber. The interception wall is formed in the pressure chamber by connecting one portion of the outer wall and one portion of the inner wall. Since the interception wall is formed in a ring shaped pressure chamber, the operation fluid is rectified in the ring shaped pressure chamber and flows out to the outflow passage in a condition of laminar flow. Therefore, the operation fluid can be supplied to an outside device in a stable state.

Preferably, the interception wall is formed to prevent the operation fluid streams from flowing either clockwise or counterclockwise in the ring shaped pressure chamber. Further, it is preferable that the interception wall is formed between the opening portion of the outflow passage and one of the opening portions of discharge ports which is the nearest to the outflow passage. Furthermore, it is preferable that interception wall is formed adjacent the opening of the outflow passage.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENT

An embodiment of the present invention will be described with reference to the drawings.

Figure 1:
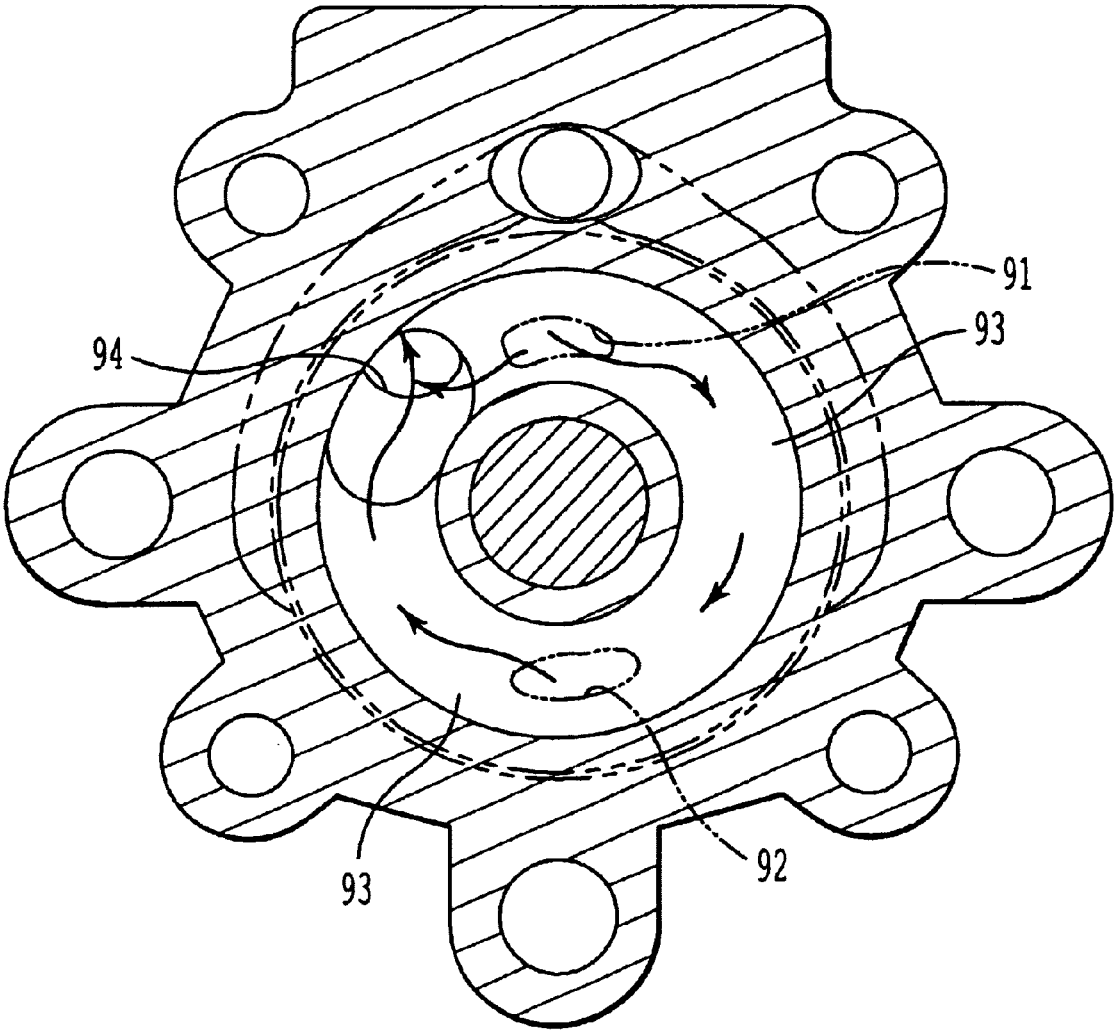
FIG. 1 RELATED ART
FIG. 1 is a cross-sectional view of a conventional rotary pump apparatus.
Figure 2:
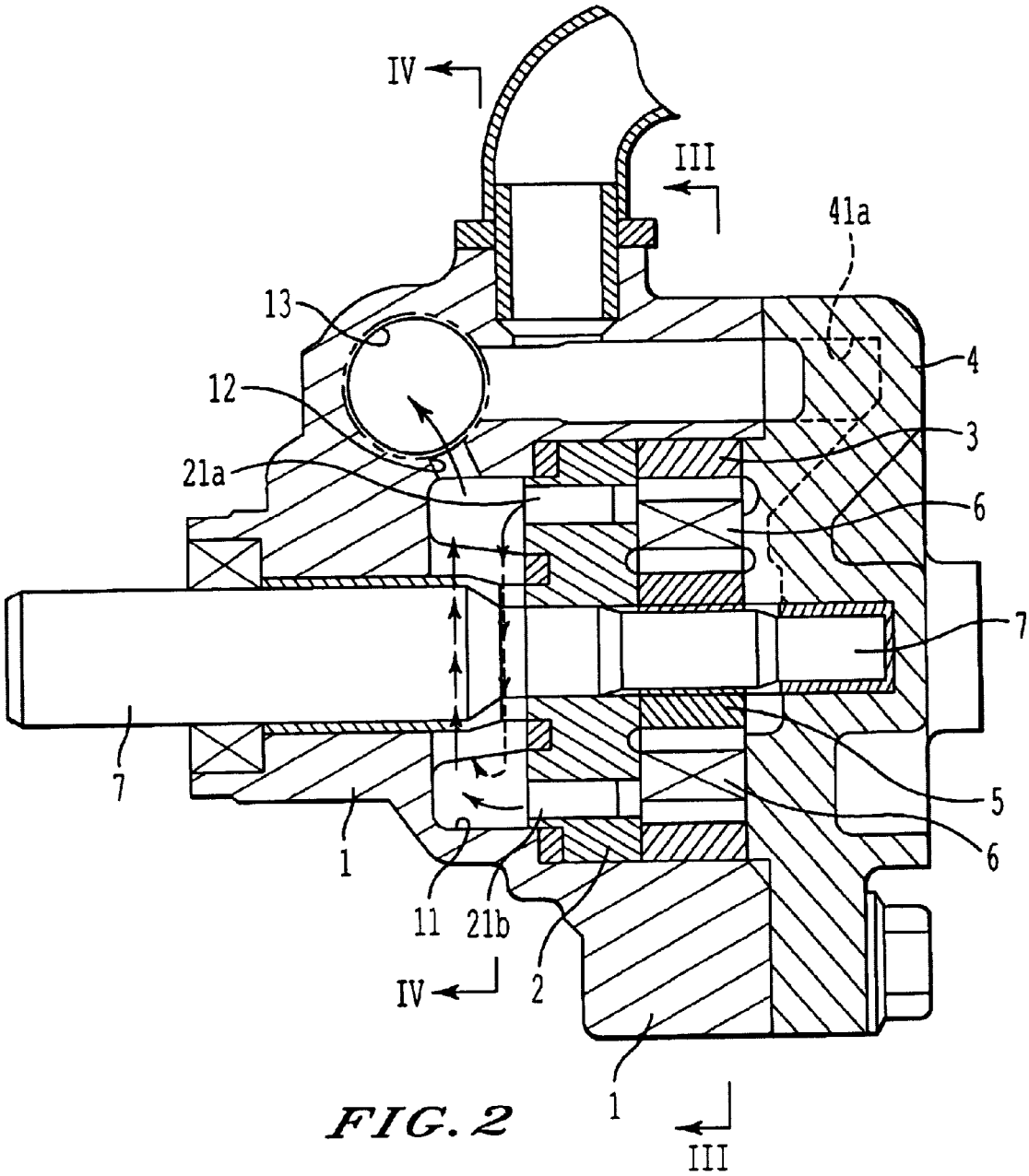
FIG. 2 is a cross-sectional view of a rotary pump apparatus according to an embodiment of the present invention.
Figure 3:
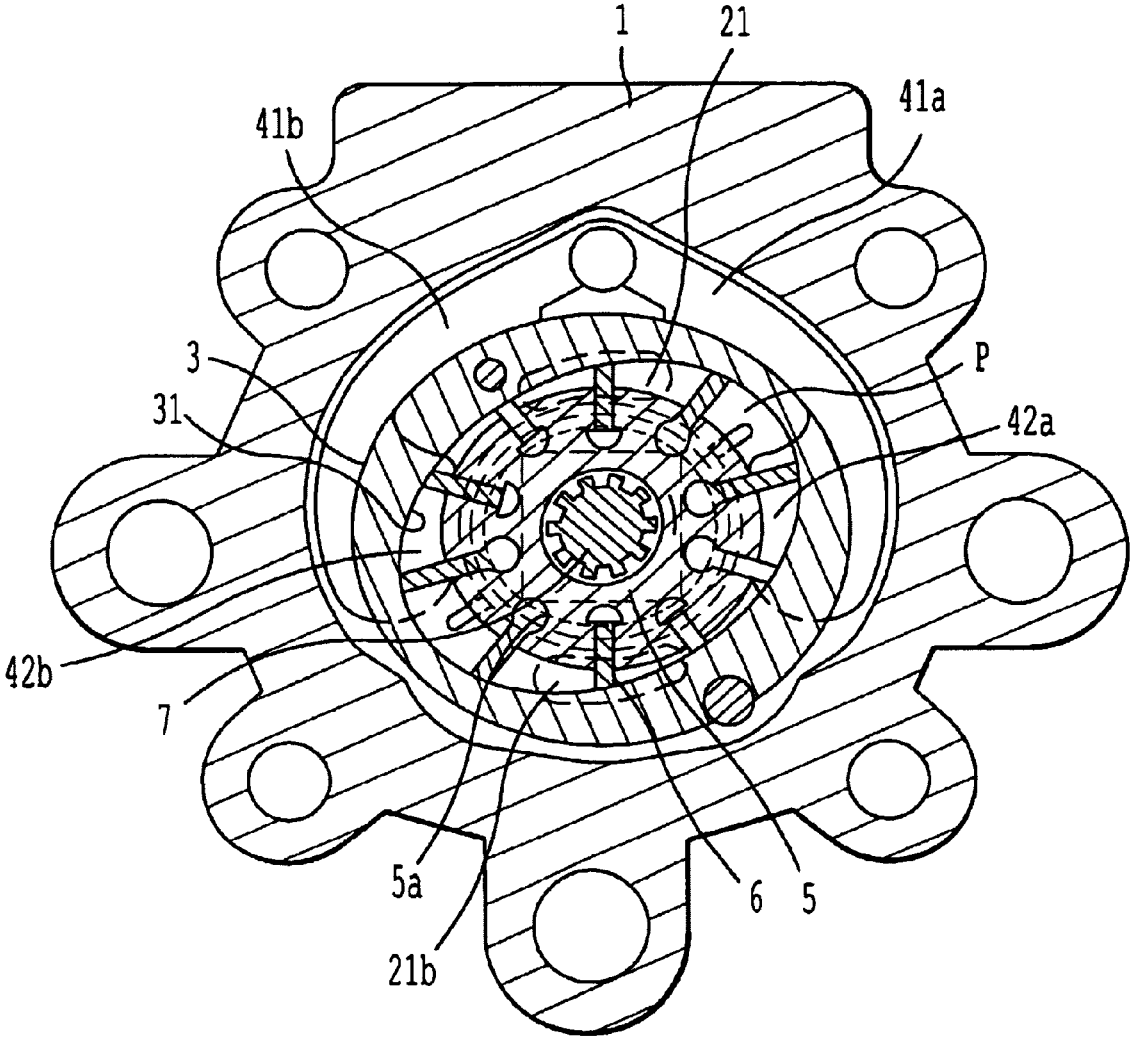
FIG. 3 is a cross-sectional view taken along line III—III in FIG. 2.

Referring to FIG. 2 and FIG. 3, a vane-type rotary pump apparatus according to the embodiment comprises a stator housing 1 with a stepped cylindrical bore formed therein. A side plate 2 and a cam ring 3 are disposed in the cylindrical bore. The cam ring 3 slidably contacts the side plate 2 and an end cover 4 at each side surface thereof. The end cover 4 is fixed to the stator housing 1 in a fluid tight manner to close the cylindrical bore. A cam surface 31, that is an ellipse-curve, is formed on an inner surface of the cam ring 3. A pump cavity is defined as a space that is enclosed by the cam surface 31, the side plate 2 and the end cover 4. A rotor 5 is rotatably disposed in the cam ring 3. Plural slits 51 are formed radially in the rotor to each slidably support a vane 6 therein. The adjacent vanes 6, the cam surface 31, the side plate 2, the end cover 4 and the rotor 5 define an expandable pump chamber P. A drive shaft 7 penetrates the stator housing 1 and the side plate 2, and is fixed in a center hole of the rotor 5. The drive shaft 7 is rotatably supported by the stator housing 1 and the end cover 4, and is rotated by a drive source (not shown) to drive the rotor.

Two inflow passages 41*a*, 41*b* are formed in the end cover 4. One end of each inflow passages 41*a*, 41*b* is connected with a reservoir (not shown). The other ends of the inflow passage 41*a*, 41*b* are opened in the expanded pump chambers P and form suction ports 42*a*, 42*b* at portions which are spaced by 180 degrees of phase with respect to each other. On the other hand, two discharge ports 21*a*, 21*b* that are through holes in an axial direction are formed in the side plate 2. The phases of the discharge ports 21*a*, 21*b* are spaced by 180 degrees from each other, and are respectively spaced by 45 degrees from the suction ports 42*a*, 42*b*. One end of each discharge port 21*a*, 21*b* is opened in a contracted pump chamber P and the other end of each discharge port 21*a*, 21*b* is opened in a pressure chamber 11.

Figure 4:
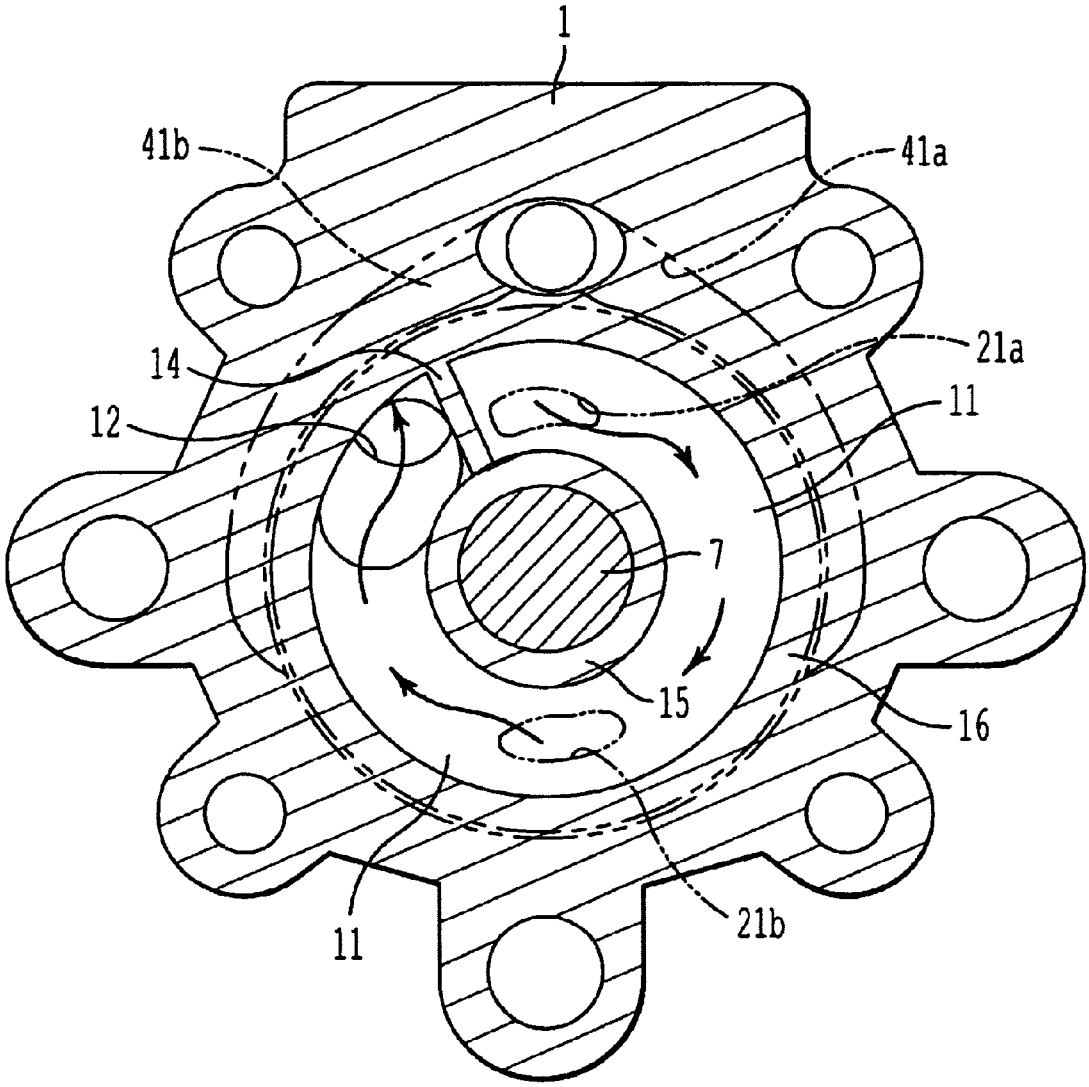
FIG. 4 is a cross-sectional view taken along line IV—IV in FIG. 2.

The pressure chamber 11 is formed in the stepped cylindrical bore of the stator housing 1, as shown in FIG. 4, and has a ring shape with an inner wall 15 and an outer wall 16. One end of an outflow passage 12 is opened in the pressure chamber 11. The other end of the outflow passage 12 is connected with a cylindrical cavity 13 in which a flow control valve (not shown) is disposed. Operation oil is supplied, via the flow control valve, to an outside device such as a power cylinder of a power steering apparatus.

As shown by FIG. 4, an interception wall 14 is radially formed in the pressure chamber 11 by connecting a part of the inside wall 15 and outside wall 16 so as to prevent flow in one direction (counterclockwise in FIG. 4) for the stream of operation fluid that is discharged from the discharge ports 21*a*, 21*b*. That is, the interception wall 14 is located between the outflow passage 12 and one discharge port 21*a*.

In the aforementioned pump apparatus, when the rotor 5 is rotated by the drive shaft 7, the operation fluid is carried from the reservoir to the suction port 42*a*, 42*b* through the inflow passages 41*a*, 41*b*. And the operation fluid that flows into the pump chamber P from the suction port 42*a*, is pumped according to rotation of the pump chamber P and flows out to the discharge port 21*a*. Similarly, the operation fluid, that flows in the pump chamber P from the suction port 42*b*, is pumped according to rotation of the pump chamber P and flows out to the discharge port 21*b*. Then, in the pressure chamber 11, the operation fluid discharged from the discharge port 21*a* flows clockwise as shown by bold arrows in FIG. 4, because the interception wall 14 prevents the counterclockwise stream of the operation fluid. And the operation fluid discharged from the discharge port 21*a* joins the other operation fluid that is discharged from the other discharge port 21*b*, and flows out to the outflow passage 12. Since the two streams of operation fluid don't collide in the pressure chamber 11, a turbulent flow of the operation fluid is prevented. Therefore, the operation fluid flows to the outflow passage 12 in a condition of laminar flow, and is supplied in a stable state to the outside device.

Now, it is possible that the interception wall 14 is instead formed between the outflow passage 12 and the other discharge port 21*b* to prevent the other direction (clockwise in FIG. 4) flow of the stream. However, if the outflow passage 12 is formed slantingly, it is preferable to prevent a stream that is opposed to the slant direction of the outflow passage 12. More particularly, if the outflow passage 12 has a slant that becomes greater in proportion to its depth in FIG. 4, it is preferable to prevent the counterclockwise stream, and to form the interception wall 14 between the outflow passage 12 and the discharge port 21*a*. Further, it is preferable that the interception wall 14 is formed at a portion which is nearest to an edge of the outflow passage 12, to assure that the operation fluid does not enter the region between the interception wall 14 and the outflow passage. Furthermore, the interception wall 14 is preferably formed integrally with the stator housing 1. However it is possible that the interception wall 14 is formed by a part separate from the stator housing 1.

Obviously, numerous modifications and variations of the present invention are possible in light of the above teachings. It is thereby to be understood that within the scope of the appended claims, the present invention may be practiced otherwise than as specifically described herein.

What is claimed is:

1. A rotary pump apparatus comprising:

a stator housing;

a pump contained in the stator housing;

at least two discharge ports positioned in the stator housing for discharging operation fluid from the pump;

a ring shaped pressure chamber formed in the stator housing and defined with an outer wall and an inner wall, into which the discharge ports open;

an outflow passage opened in the pressure chamber; and a single interception wall formed in the pressure chamber by connecting one portion of the outer wall and one portion of the inner wall, wherein said ring shaped pressure chamber incorporates said at least two discharge ports and said outflow passage, and wherein no partition wall separates said at least two discharge ports.

2. A rotary pump apparatus according to claim 1, wherein the interception wall is configured to prevent a flow of operation fluid in one of clockwise and counterclockwise directions in the ring shaped pressure chamber.

3. A rotary pump apparatus according to claim 1, wherein the interception wall is formed between an opening portion of the outflow passage and the one of the discharge ports which is nearest to the outflow passage.

4. A rotary pump apparatus according to claim 1, wherein the interception wall is formed adjacent the outflow passage.

5. A rotary pump apparatus comprising:

a stator housing;

a cam ring having an inner periphery formed as a cam surface and mounted in the stator housing;

a pair of end wall structures fitted to opposite ends of the cam ring to form a pump cavity in the cam ring;

a drive shaft rotatably mounted within the stator housing and extending into the interior of the pump cavity through one of the end wall structures;

a rotor contained within the cam ring and mounted on the drive shaft for rotation therewith;

a plurality of circumferentially equally spaced vanes positioned in the rotor to move radially outward and inward and cooperating with the cam surface of the cam ring to form a plurality of expandable pump chambers;

at least two suction ports formed on an inside face of one of the wall structures at a position where the pump chambers expand as the vanes move radially outward;

at least two discharge ports formed on the inside face of the other of the wall structures at a portion where the pump chambers contract as the vanes move radially inward;

a ring shaped pressure chamber formed in the stator housing and defined with an outer wall and an inner wall, in which the discharge ports open;

an outflow passage opened in the pressure chamber; and a single interception wall formed in the pressure chamber, said single interception wall being positioned between the outflow passage and one of the discharge ports which is nearest to the outflow passage, the interception wall connecting one portion of the outer wall and one portion of the inner wall so as to prevent one of clockwise flow and counterclockwise flow of the operation fluid in the ring shaped pressure chamber, wherein said ring shaped pressure chamber incorporates said at least two discharge ports and said outflow passage, and wherein no partition wall separates said at least two discharge ports.

6. A rotary pump apparatus comprising:

a stator housing;

pump means in the stator housing for pumping operation fluid;

at least two discharge ports for discharging the operation fluid from the pump means;

a ring shaped pressure chamber formed in the stator housing, into which the discharge ports open;

an outflow passage opened in the pressure chamber; and interception means comprising a single wall for preventing one of clockwise and counterclockwise flow of operation fluid in the ring shaped pressure chamber, wherein said ring shaped pressure chamber incorporates said at least two discharge ports and said outflow passage, and wherein no partition wall separates said at least two discharge ports.

* * * * *